United States Patent [19]

Harreither

[11] Patent Number: 4,958,558

[45] Date of Patent: Sep. 25, 1990

[54] ADJUSTING SYSTEM FOR THE GAP WIDTH OF SUPPORT ROLL PAIRS IN A DOUBLE-BELT PRESS

[75] Inventor: Rupert Harreither, Baden, Austria

[73] Assignee: Austria Metall Aktiengesellschaft, Braunau, Austria

[21] Appl. No.: 413,529

[22] Filed: Sep. 27, 1989

[30] Foreign Application Priority Data

Sep. 27, 1988 [AT] Austria ..... 2375/88

[51] Int. Cl.[5] ..... B30B 13/00; B30B 5/06

[52] U.S. Cl. ..... 100/41; 100/35; 100/151; 100/154; 100/168; 100/170; 72/244

[58] Field of Search ..... 100/163 R, 168, 169, 100/170, 47, 35, 41, 118–120, 151, 153, 154, 176, 155 R, 156; 68/256, 262 R; 72/244

[56] References Cited

U.S. PATENT DOCUMENTS

| | | | |
|---|---|---|---|
| 3,104,608 | 9/1963 | Ribbans, III | 100/154 X |
| 3,367,263 | 2/1968 | Quenter | 100/168 |
| 3,856,462 | 12/1974 | Mueller | 100/168 X |
| 4,202,192 | 5/1980 | Haneda et al. | 72/244 X |
| 4,269,140 | 5/1981 | Burns et al. | 100/47 X |
| 4,547,254 | 10/1985 | Berner | 100/154 X |

*Primary Examiner*—Harvey C. Hornsby
*Assistant Examiner*—Stephen F. Gerrity
*Attorney, Agent, or Firm*—Herbert Dubno

[57] ABSTRACT

A simple adjustment device for the width of the gap between the support rolls of a double-belt press has conical formations at ends of the rolls bearing against one another and utilizes a relative axial shift of the two rolls to adjust the gap width.

7 Claims, 2 Drawing Sheets

ADJUSTING SYSTEM FOR THE GAP WIDTH OF SUPPORT ROLL PAIRS IN A DOUBLE-BELT PRESS

CROSS REFERENCE TO RELATED APPLICATION

This application is related to my concurrently filed copending application Ser. No. 07/413,527 filed Sept. 27, 1989.

FIELD OF THE INVENTION

My present invention relates to a system for adjusting the gap width between support roll pairs in a double-belt system and, more particularly, to a simple and reliable apparatus for incorporation into a double-belt press which can adjust the spacing of a support roll pair from one another.

BACKGROUND OF THE INVENTION

In a double-belt press, each of two belts is guided along respective arrays of support rollers and the material to be subjected to the pressing or conveying operation of the double-belt system is engaged between the belts and conveyed in succession between the rolls of the support roll pairs.

The adjustment of the gap width of the press and hence the spacing between pairs of support rolls has been effected in accordance with known techniques by relative adjustment of the upper and lower machine frames upon which the support rolls were mounted and/or by individual adjustments of the support rolls.

In the case of a plurality of support roll pairs, where each roll pair must be adjusted under load to the correct gap width, it has been necessary to provide extensive measurement and control devices and procedures for such adjustment.

If one abandons the effort to adjust the individual gap widths of each individual roll pair and merely monitors the final thickness of the pressed produce and adjusts the gap widths in a feedback response, the machine may not operate in its most efficient and optimum manner since the various roll pairs themselves may not operate at optimum working points.

OBJECTS OF THE INVENTION

Accordingly, it is the principal object of the invention to provide a simple and low-cost apparatus for adjusting the roll gaps.

Another object of my invention is to provide an adjusting device or system for the gaps between the support roll pairs in a double-belt system whereby drawbacks of earlier arrangements are obviated.

SUMMARY OF THE INVENTION

These objects and others which will become apparent are attained in an adjusting device, system or mechanism for a pair of support rolls in a double-belt system in which at the ends of each of the rolls of the respective pair, rotationally symmetrical formations are provided which bear directly upon one another, and these formations are generally conical with the conical formations of each roll being similarly oriented and the bearings of the rolls being shiftable relative to one another with the respective rolls.

Advantageously the two support rolls are provided at their ends outside the regions of the belt and the conveyed material with cones having the same direction of taper for a given roll and a direction of taper opposite that of the other roll of the respective pair.

Advantageously, to reduce the friction force between the conical formations which roll on one another, one or both of the radially engaging conical formations can be rounded or convex to form a spherical segmental surface.

Advantageously, one of the support rolls of each pair is mounted so as to be axially shiftable while the other roll of the respective pair, i.e. the cooperating support roll, is shiftable radially with respect to the axes of the rolls.

In this latter embodiment, the system of the invention has the advantage that each pair of bearings for a roll need only have one degree of freedom of mobility. This amounts to a great simplification of the system.

Furthermore, the shifting of the rolls in the axial or the radial direction can be effected by cylinders which are connected to the respective rolls at the bearings thereof.

For adjustment of the gap between rolls, therefore, I can shift the axially displaceable roll in the axial direction and then permit the radially shiftable roll to follow this displacement in the radial direction to maintain the radial engagement of the conical formations of the rolls.

The relative axial displacement of the support rolls can correspond to the configuration of the conical formation, vary the distance between the two support rolls of a roll pair. It is only required for this purpose that the conical formations of the two rolls continuously engage each other radially. With a corresponding agreement of the load on the support rolls with the reaction pressure of the product, there is only a small pressure difference applied to the conical formations so that gap adjustment can be effected even during operation.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
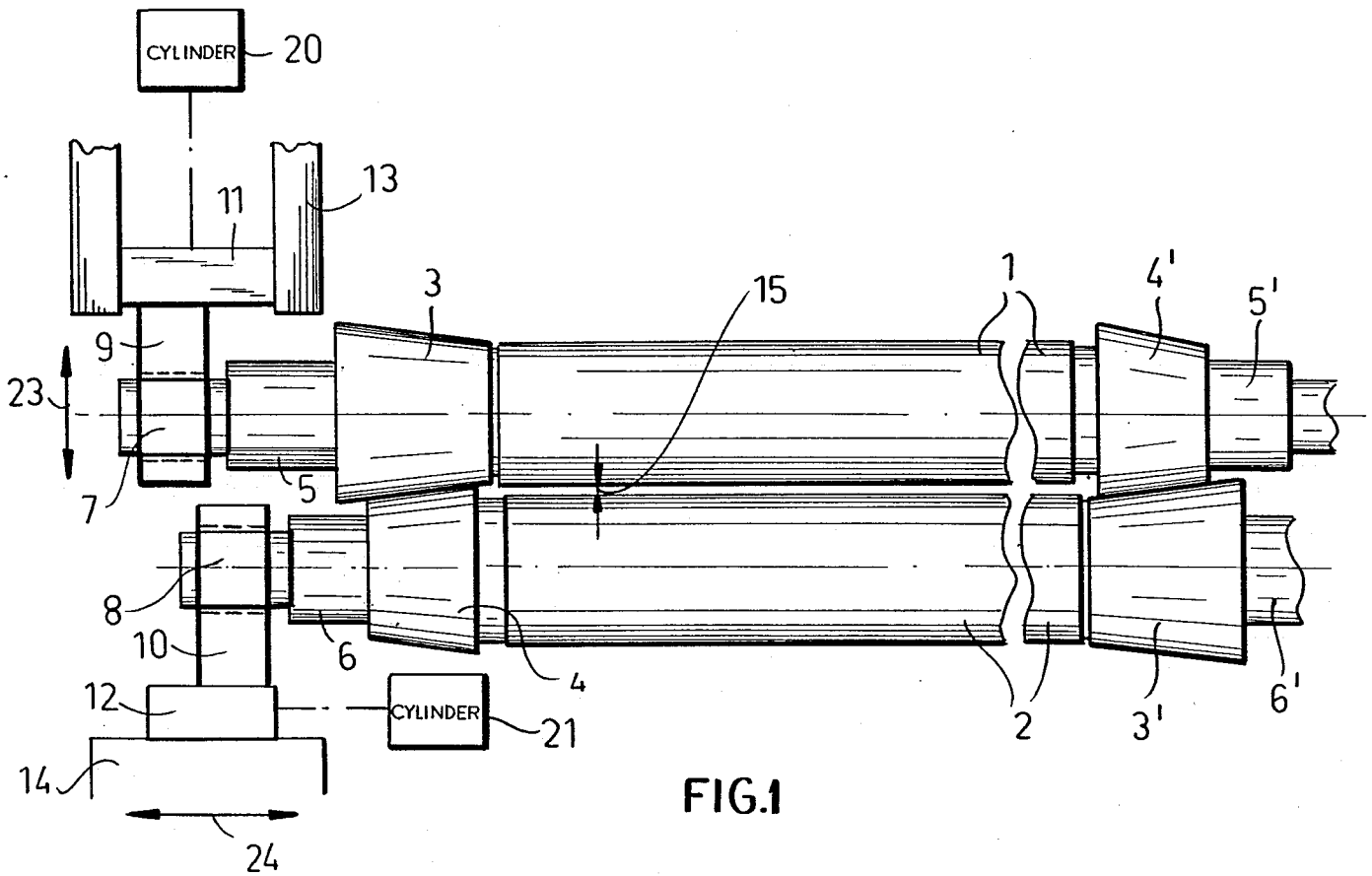
FIG. 1 is an elevational view in highly diagrammatic form illustrating the relationship between two rolls of a support roll pair of a double-belt system.
Figure 2:
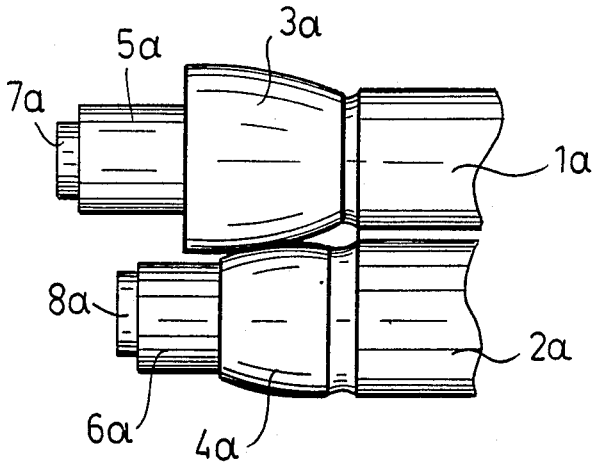
FIG. 2 is a view of the conical formations having rounded surfaces.
Figure 3:
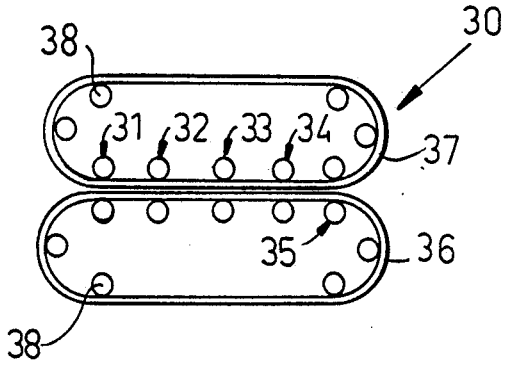
FIG. 3 is a diagrammatic elevational view illustrating in principle the arrangement of support-roll pairs in a double-belt system.

Referring first to FIG. 3, it can be seen that a double-belt press 30, in principle, comprises a multiplicity of pairs 31–35 of support rolls which are juxtaposed with one another and can correspond to the pairs 1 and 2 of the support rolls shown in FIGS. 1 and 2.

Belts 36 and 37 pass along the support rolls and can engage an article or material to be pressed in a continuous manner through the system. Additional rollers 38 can be provided to complete the guide paths for the belts. The double-belt press shown in FIG. 3 has an idealized form, but it will be understood the invention is generally applicable to double-belt systems using support roll pairs in the manner described herein.

The mutually cooperating support rolls 1 and 2 (FIG. 1) are formed at their ends with conical formations 3 and 4' and 4 and 3', respectively, which roll against one another and, to reduce frictional contact, can be outwardly convex as shown at 3a and 4a for the rolls 1a and 2a in FIG. 2 and which otherwise are similar to the rolls 1 and 2 of FIG. 1. The stubs 5a, 6a and the bearings 7a and 8a have also been illustrated in FIG. 2.

At their ends, the rolls 1 and 2 carry shaft stubs 5, 5' and 6, 6' upon which the bearing in 7, 8 are formed. The latter are arranged in the bearings 9 and 10.

The bearings 9 and 10 are fixed in bearing carriers 11 and 12 which are shiftable in the frame members 13 and 14.

The two shifting systems can be a cylinder arrangement 20 as can be seen diagrammatically in FIG. 1 or a cylinder arrangement 21, respectively connected to the bearing carriers 11 and 12 for displacing these bearing carriers in the direction represented by the arrows 23 and 24, respectively.

For example, the axial shifting cylinder 21 can displace the roll 2 of the left while the cylinder 20 allows the roll 1 to move upwardly and thereby increase the width of the gap 15. Conversely a displacement of the roll 2 to the right, coupled with forcing of the roll 1 downwardly so that the conical formations 3, 4 and 4', 3' continue to engage, will reduce the width of the gap. After the width of the gap 15 has been set, further adjustments are possible using the cylinders 20 and 21.

The invention is not limited to the described embodiment but can include all modifications within the spirit and scope of the appended claims.

I claim:

1. An adjusting apparatus for a double-belt press, comprising:

a pair of support rolls;

respective bearings journaling said rolls for rotation about generally parallel axes;

respective generally conical formations at each end of each of said rolls bearing radially upon the conical formations of the other roll, the conical formations of each roll tapering in the same direction; and means for relatively shifting the bearings of said rolls whereby axial regions at which the conical formations of the two rolls bear upon one another are shifted to vary the width of a gap formed between said rolls.

2. The adjusting apparatus defined in claim 1 wherein the two rolls are formed with said conical formations at opposite ends of said support rolls outside a zone for receiving belts of a double belt press and wherein the conical formations of one of the rolls are tapered in a direction opposite a direction of taper of the conical formations of the other roll.

3. The adjusting apparatus defined in claim 2 wherein said conical formations are convex.

4. The adjusting apparatus defined in claim 2 wherein the bearings of one of said rolls are mounted for axial displacement of said one of said rolls and the bearings of the other roll are mounted for radial displacement relative to the axes of said one of said rolls.

5. The adjusting apparatus defined in claim 2, further comprising roll-shifting means connected to said rolls and acting on the roll bearings thereof.

6. The adjusting apparatus defined in claim 5 wherein said roll-shifting means include respective fluid-pressure cylinders.

7. A method of adjusting a gap between two support rolls of a double-belt press comprising the steps of :

(a) causing a generally conical formation at opposite ends of said rolls to roll against one another radially, a direction of taper of the conical formations of one of said rolls being opposite the direction of taper of the conical formations of the other roll and the conical formations of each roll having the same taper direction; and (b) axially shifting one of said rolls relative to the other of said rolls to adjust regions of contact of said conical formations with one another to vary a radial gap width between said support rolls.

* * * * *